United States Patent [19]

Butterworth

[11] Patent Number: 4,780,061

[45] Date of Patent: Oct. 25, 1988

[54] SCREW COMPRESSOR WITH INTEGRAL OIL COOLING

[75] Inventor: Arthur L. Butterworth, La Crosse, Wis.

[73] Assignee: American Standard Inc., New York, N.Y.

[21] Appl. No.: 82,158

[22] Filed: Aug. 6, 1987

[51] Int. Cl.[4] ..... F04B 17/00

[52] U.S. Cl. ..... 417/371; 417/372; 417/902; 418/85; 418/89; 418/98; 418/DIG. 1; 184/6.22

[58] Field of Search ..... 417/372, 902, 366, 371; 418/85, 97, 98, 89, 201, DIG. 1; 184/6.22, 6.24

[56] References Cited

U.S. PATENT DOCUMENTS

| | | | |
|---|---|---|---|
| Re. 30,994 | 7/1982 | Shaw | 230/139 |
| 2,001,857 | 5/1935 | Watson | 184/6.22 X |
| 2,199,414 | 5/1940 | Patrignani | 417/372 |
| 2,239,723 | 4/1941 | Limpert et al. | 417/902 X |
| 2,297,220 | 9/1942 | Hintze | 417/902 X |
| 2,668,007 | 2/1954 | Szaniszlo | 417/902 X |
| 2,868,382 | 1/1959 | Best | 184/6.24 X |
| 2,956,730 | 10/1960 | Hamilton et al. | 417/372 |
| 3,300,965 | 1/1967 | Sherlaw et al. | 184/6.22 X |
| 3,408,827 | 11/1968 | Soumerai et al. | 417/372 X |
| 3,514,225 | 5/1970 | Monden et al. | 230/206 |
| 3,708,959 | 1/1973 | Soumerai et al. | 55/5 |
| 3,710,590 | 1/1973 | Kocher | 418/85 X |
| 3,850,554 | 11/1974 | Zimmern | 418/85 X |
| 4,497,185 | 2/1985 | Shaw | 62/468 |

*Primary Examiner*—Carlton R. Croyle
*Assistant Examiner*—Theodore Olds
*Attorney, Agent, or Firm*—William J. Beres; David L. Polsley; Robert J. Harter

[57] ABSTRACT

A screw compressor assembly includes a motor housing section, a compressor section and an oil separator downstream of the compressor discharge port. The motor housing section defines a flow path for suction gas traveling to the working chamber of the compressor so that the compressor drive motor is cooled by suction gas. The motor housing section also internally defines an integral heat exchange structure through which a passage for the flow of oil is defined. Discharge pressure in the oil separator drives separated oil into the passage in the motor housing heat exchange structure prior to the delivery of such oil to compressor surfaces requiring lubrication. The oil flowing through the integral heat exchange structure is cooled by the suction gas passing over the surface of the heat exchange structure interior of the motor housing.

20 Claims, 2 Drawing Sheets

SCREW COMPRESSOR WITH INTEGRAL OIL COOLING

BACKGROUND OF THE INVENTION

The present invention is directed to the cooling of the lubricating oil which is provided to various bearing surfaces in a screw compressor. More particularly, it relates to the cooling of oil separated from the mixture of gas and oil discharged at high temperature and pressure from a screw compressor by bringing such oil into a heat exchange relationship with compressor suction gas and ambient air.

Oil is employed for a variety of purposes in screw compressors. It is typically directed to the various compressor bearing surfaces for lubrication purposes and is injected into the working chamber of the compressor for cooling and sealing purposes.

After being used for lubrication, oil is often vented to an area of a screw compressor which is at suction pressure. Such oil is carried into and through the compressor working chamber entrained in the gas undergoing compression therein. Oil is also typically injected directly into the working chamber of a screw compressor at a location where the pressure of the medium being compressed is higher than suction pressure yet lower than discharge pressure. Such oil acts as both a sealant and coolant within the working chamber and likewise becomes entrained in the gas being compressed. Oil entrained in the gas compressed in a screw compressor must be separated from the discharge gas for continuous re-use within the compressor.

Oil used in any lubrication system will typically be more effective if cooled prior to its delivery to bearing surfaces because cooled oil is more viscous and results in higher bearing reliability. Screw compressor systems are different from typical compressor systems by virtue of the relatively very large amount of oil which is carried out of a screw compressor in the discharge gas and because such oil exits a screw compressor at relatively high temperatures and pressures.

In screw compressor applications, dedicated oil cooling apparatus and circuitry will commonly be found to exist which generally includes dedicated external heat exchangers, filters, mechanical pumps and intricate piping. Typical in this regard are the screw compressor lubrication systems disclosed in U.S. Pat. Nos. 3,708,959 and 4,497,185. Such systems are cumbersome, expensive, subject to mechanical breakdown and can cause the physical dimensions of the compressor assembly to exceed space limitations.

One common method of oil cooling in non-screw compressor applications involves bringing oil into direct heat exchange contact with compressor suction gas. Most hermetic compressors other than screw compressors are "low-side" compressors, i.e. compressors in which suction gas dumps directly into the hermetic shell of the compressor so that the interior of the shell is at low pressure. Such gas is typically in direct contact with the oil which drains to a sump area at the bottom of the compressor shell. Because sump oil in a low-side compressor is directly exposed to and is cooled by suction gas interior of the compressor's hermetic shell, it typically does not require further cooling or the employment of dedicated oil cooling apparatus. However, such convenience is unavailable in the case of screw compressors due to the discharge temperatures and pressures to which compressor lubricating oil is exposed.

U.S. Pat. No. 3,514,225 to Monden et al. discloses the immersion of a "suction cup" in the sump of a "high-side" rotary refrigeration compressor, i.e., a compressor having a housing the interior of which is at discharge pressure, for the dual purposes of cooling sump oil and for vaporizing any liquid refrigerant passing into the suction cup which might otherwise enter the compressor. The suction cup of the Monden et al. patent is a formed element interposed in a portion f the suction line found within the hermetic shell of the Monden compressor. The primary purpose of the Monden suction cup is to prevent the mechanical damage to the compressor which would result from the introduction of liquid refrigerant into the compressor's working chamber. The suction cup of Monden is a discrete element mounted internal of the hermetic shell of a compressor and is plumbed into the suction piping leading to the compressor's working chamber.

U.S. Pat. Re. No. 30,994, to Shaw, teaches the disposition of an oil carrying capillary coil in a sleeve through which suction gas is directed to the suction port of a high-side screw compressor. This small capillary line taps off of a main lubricating oil supply line and directs a small portion of the oil initially found in the lubricating oil piping to an injection point that opens into the working chamber of the compressor. The temperature of injection oil in the Shaw patent is reduced as the suction gas flows over the capillary coil disposed within the suction sleeve thereby improving the ability of the injection oil to provide a seal internal of the compressor working chamber.

The need exists to provide for the cooling of lubricating oil in a high-side screw compressor application without the use of discrete external components dedicated to the oil cooling function.

SUMMARY OF THE INVENTION

It is an object of the present invention to cool oil used for lubrication purposes in a screw compressor.

It is another object of the present invention to cool compressor lubricating oil using suction gas.

It is a further object of the present invention to cool lubricating oil in a high-side compressor application using both suction gas and ambient air.

It is a still further object of the present invention to cool compressor lubricating oil without the employment of dedicated or discrete pumping devices, external piping, or other related apparatus which requires mounting or connection to other components within the compressor assembly.

Another object of the present invention is to cool compressor lubricating oil in a manner which encourages the disentrainment of debris from the oil and to filter such oil prior to its delivery to compressor bearing surfaces.

It is also an object of the present invention to increase the viscosity of the lubricating oil in a screw compressor by cooling the oil integrally within the compressor so as to result in the enhancement of bearing reliability.

Finally, it is an object of the present invention to controllably deliver filtered and suction-gas-cooled lubricating oil to the bearing surfaces in a screw compressor in a manner which minimizes suction gas superheating and which extends the range of compressor operating temperatures.

These and other objects of the invention, which will become apparent from the following Description of the Preferred Embodiment and from the attached Drawing, are accomplished in a screw compressor wherein oil is separated from the mixture of gas and oil discharged at high temperature and pressure from the working chamber of a screw compressor. Discharge pressure is employed to drive such separated oil from an oil sump, into and through a restricted passage. The oil is controllably delivered to an annular integrally formed heat exchanger within the compressor drive motor housing. The heat exchange structure is exposed to the flow of suction gas as such gas passes through the drive motor housing to the compressor and is also in heat exchange contact with the ambient exterior of the housing.

The internally extending annular nature of the integral heat exchanger structure within the motor housing encourages the transfer of heat from the oil to compressor suction gas and causes any debris in the lubricating oil to be centrifugally carried to the radially outer portion of the flow passage within the heat exchange structure. A filtering media is disposed in the passage to capture such debris. The present invention allows for the controlled cooling of compressor lubricating ol while advantageously eliminating the need for discrete oil cooling components/apparatus in a screw compressor. Further, it allows for the cooling of such lubricating oil in a manner which eliminates weight and bulk and which does not affect the exterior dimensions of the compressor assembly.

DESCRIPTION OF THE PREFERRED EMBODIMENT

Figure 1:
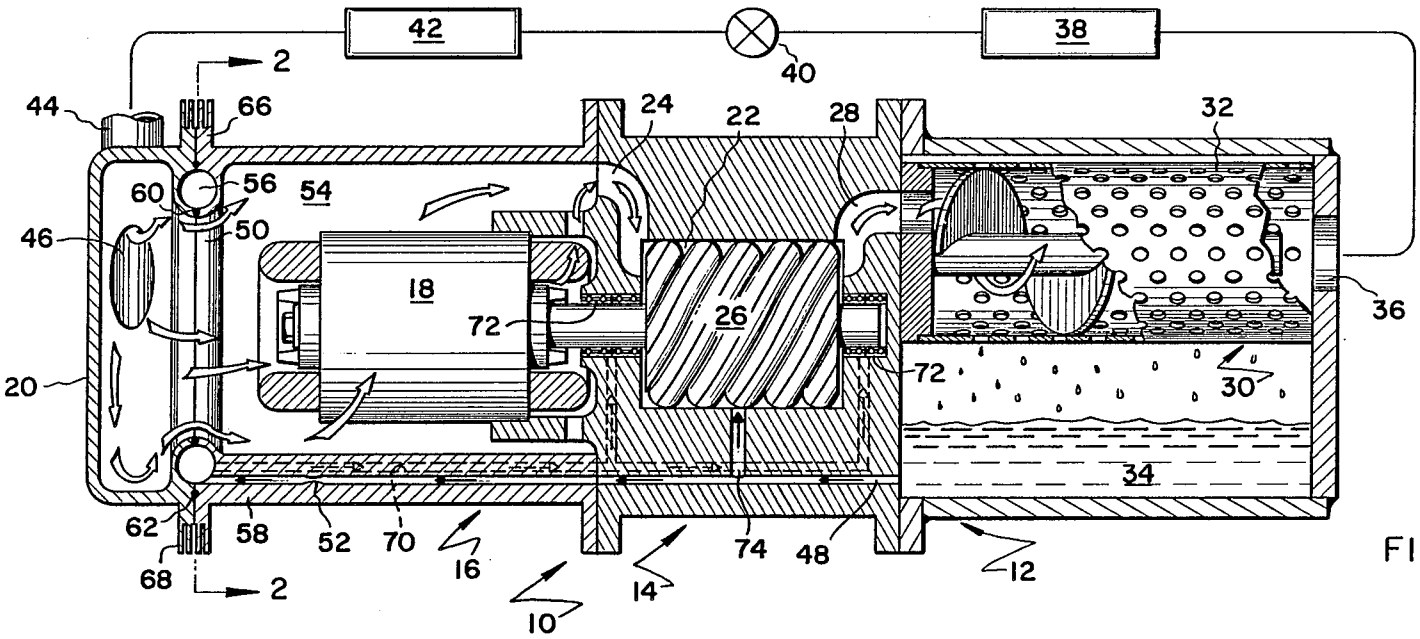
FIG. 1 is a cross-sectional view taken along the longitudinal axis of the screw compressor assembly of the present invention.
Figure 3:
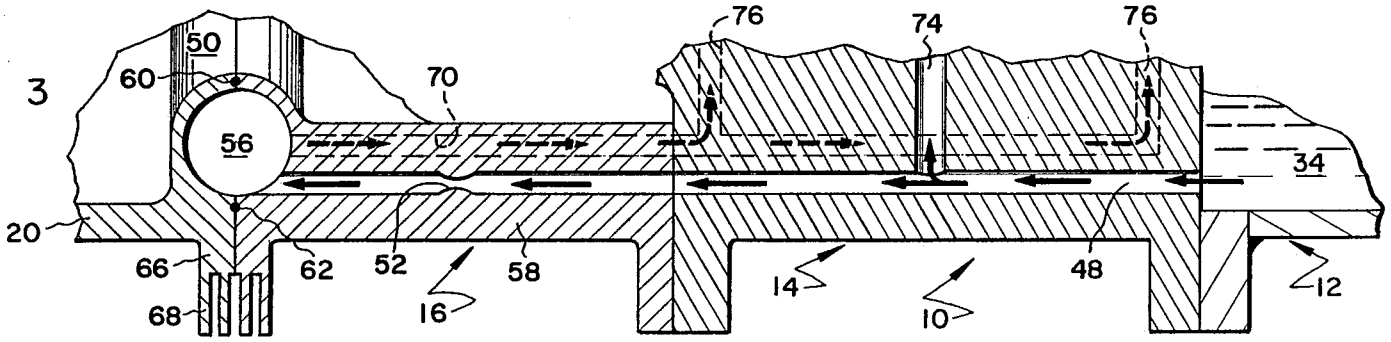
FIG. 3 is an enlarged view of a portion of the oil flow path illustrated in FIG. 1.
Figure 2:
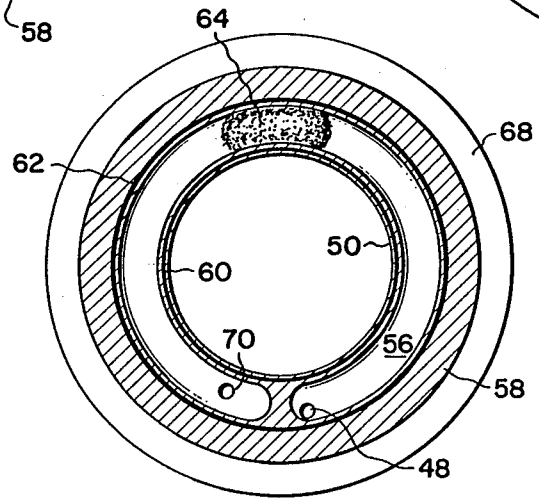
FIG. 2 is a sectional view taken along line 2—2 of FIG. 1.

Referring to FIGS. 1, 2 and 3 concurrently, it will be seen that screw compressor assembly 10 is generally comprised of three relatively discrete sections, an oil separator section 12, a compressor 14 and a motor housing section 16. Access to compressor drive motor 18 within motor housing section 16 is conveniently provided through a removable end cap 20. Motor 18 is therefore semi-hermetically enclosed within motor housing 16.

Suction gas enters working chamber 22, which is defined by compressor 14, through a suction port 24. The suction gas is compressed, and therefore heated, between the pair of meshing screw rotors mounted for rotation within the working chamber. Only one rotor, 26, is illustrated in FIG. 1.

As has been and will further be discussed, oil is introduced into the working chamber 22 of the compressor housing in a number of ways. Such oil becomes entrained in the gas undergoing compression within the working chamber. A mixture of relatively high temperature and high pressure refrigerant gas and oil is discharged from working chamber 22 through a discharge port 28. This mixture is directed into centrifugal oil separator 30 disposed in oil separator section 12 of the compressor assembly. Although separator 30 is preferably a centrifugal separator, it will be appreciated that it can be other than a centrifugal oil separator. Many types of oil separators are known to be employed with screw compressors.

As the hot discharge mixture passes through the passage internally defined by oil separator 30, the oil, which is heavier than the gaseous portion of the mixture, is centrifugally forced radially outward interior of the separator and eventually passes through permeable outer shell 32. The hot oil falls into sump 34 which is defined interior of the oil separator section 12. Because shell 32 of separator 30 is permeable, the interior of oil separator section 12 is at discharge pressure when the compressor is in operation, as is the oil in sump 34.

Compressed refrigerant gas, from which oil has been separated, passes out of oil separator section 12 via port 36 and is delivered, in a typical screw refrigeration system, to a condenser 38. Condensed refrigerant is next delivered through expansion valve 40 to an evaporator 42. Reltively cool vaporized refrigerant gas is then delivered from evaporator 42 via suction piping 44 into the interior of motor housing section 16 through a port 46 in end cap 20 of the motor housing. The suction gas is drawn through the interior of motor housing section 16 back into suction port 24 after being drawn over and through compressor drive motor 18 so as to cool the motor.

Focusing now on FIGS. 1, 2 and 3, and on the oil system of screw compressor assembly 10, it will be seen that hot oil will be driven, under the impetus of discharge pressure, out of sump 34 of oil separator section 12 into oil feed line 48. Feed line 48 is a passage for the flow of oil from sump 34 to the integral internal heat exchanger 50 in motor housing section 16. The flow of oil from sump 34 to heat exchanger 50 is controllably regulated by restrictor 52 which is disposed in the oil feed line. The purpose of restrictor 52 is to allow for the passage of lubricating oil to heat exchanger 50 in a predetermined amount and in a controlled fashion so as to satisfy bearing lubrication needs within the compressor while not contributing to suction gas superheating to an appreciable degree. It will be appreciated that while at its simplest, restrictor 52 may be a mere physical restriction or orifice in passage 48, such restriction might also be accomplished through the use of a valve in the passage. Such a valve will preferably be a constant flow valve.

It will be seen, in FIGS. 1 and 3, that heat exchanger 50 is annular in nature and that annular passage 56 is formed and closed when end cap 20 is assembled onto the main motor housing 58 of motor housing section 16. Main motor housing 58 is essentially a cylindrical sleeve which is attached to compressor 14. Housing 58 is disposed over and around compressor drive motor 18. End cap 20 is attached to main motor housing 58 in a conventional and convenient manner such as by bolts (not shown) so that semi-hermetic sealing of the motor housing is accomplished when the abutting surfaces of the end cap and the main motor housing are brought into contact during assembly. Motor 18, end cap 20 and main motor housing 58 will be understood to comprise a compressor drive motor assembly.

To facilitate sealing around annular passage 56 within the assembled motor housing section, inner and outer gaskets or 0-rings 60 and 62 are disposed between the abutting surfaces of the end cap and main motor housing.

Integral heat exchanger 50 is preferably thin walled so as to promote the transfer of heat between refrigerant gas being drawn over its surface and the oil flowing interior of it through annular passage 56. The portions of the abutting surfaces of end cap 20 and main motor housing 58 which cooperate to form heat exchanger 50 and to define annular passage 56 are preferrably cast, machined, milled or otherwise integrally formed within the end cap and main motor housing surfaces which are brought into abutment upon assembly of the end cap to the main motor housing.

It will be seen that heat exchanger 50 extends radially inward into the interior 54 of motor housing section 16 so as to constrain the relatively cool suction gas entering motor housing section 16 through port 46 to pass in intimate heat exchange contact with the exposed surface of heat exchanger 50. The cooling of the hot oil flowing through passage 56 interior of heat exchanger 50 is thereby accomplished.

The flow of oil through passage 56 is illustrated best in FIGS. 2 and 3. Oil entering passage 56 from feed line 48 is forced by the discharge pressure which exists upstream of the passage in sump 34, through filtering media 64. Media 64 acts to trap and block the further passage of debris within the oil stream. It will be noted that because of the annular nature of flow passage 56, debris will tend to be urged radially outward within passage 56 by centrifugal force. Therefore, the distribution of debris in the filter will tend to be at its upper portion, thereby ensuring that flow passage 56 remains unclogged even as debris accumulates in the filtering media. It will also be noted that because end cap 20 of motor housing section 16 is removable, media 64 can conveniently be changed out and that the oil flow passages are accessible for cleaning.

Oil flowing through passage 56 is additionally and purposefully brought into a heat exchange relationship with the ambient surrounding motor housing section 16 t the interface of end cap 20 and main motor housing 58 by virture of the basic fin-like stucture of composite flange 66. The capacity for heat transfer of composite flange 66 is further enhanced by the integral annular fins 68 which extend radially outward from the abutting flanges of end cap 20 and main motor housing 58. End cap 20 and main motor housing 58 cooperate to form composite flange 66 and integral internal heat exchanger 50 when in abutment. Composite flange 66 will be seen to comprise an integral external heat exchange structure of motor housing section 16 which is proximate oil flow passage 56 of internal heat exchanger 50.

Cooled oil exits passage 56 and next enters oil feed line 70 from which it is directed, still under the influence of the discharge pressure in the upstream oil separator section, to various bearing surfaces 72 in the compressor assembly. Such bearing surfaces and locations are typically vented to locations within the compressor assembly that are at suction pressure. This pressure differential promotes the continuous flow of oil to the bearing surfaces from oil sump 34 after its passage through internal integral heat exchanger 50. Upon leaving the locations which require lubrication in the compressor the lubricating oil is carried by suction gas into the working chamber of the compressor.

In the preferred embodiment of the present invention, the oil which is to be injected directly into the working chamber 22 of the compressor for sealing purposes is not directed to heat exchanger 50 but is tapped off through a passage 74 which leads from feed line 48 directly to the working chamber of the compressor. While the tapping off and non-cooling of injection oil is preferred in the compressor assembly of the present invention, it may be advantageous in some instances or compressor designs to pass all of the compressor assembly oil through heat exchanger 50. The passing of the entire amount of compressor assembly oil through heat exchanger 50 is contemplated as being within the scope of the present invention.

Figure 5:
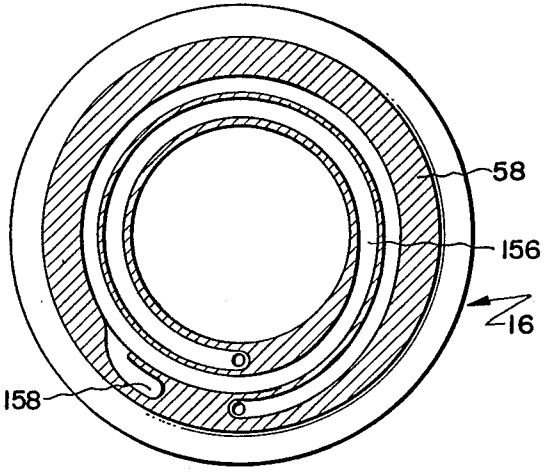
FIG. 5 is a view taken along line 5—5 of FIG. 4.
Figure 4:
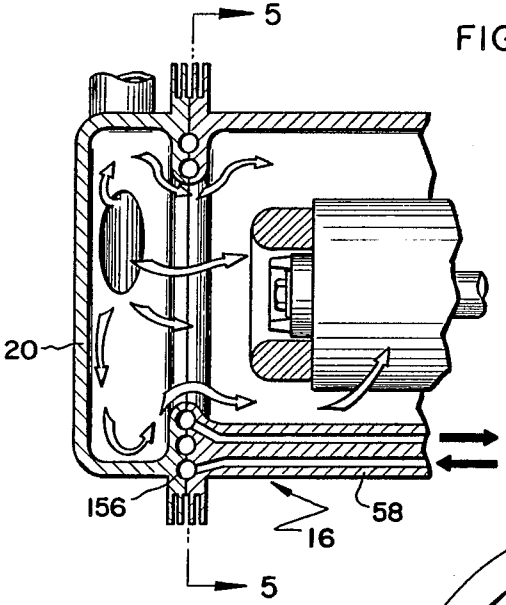
FIG. 4 illustrates an alternative embodiment of the present invention.

Referring now to FIGS. 4 and 5, an alternative embodiment of the present invention is illustrated. In the embodiment of FIGS. 4 and 5, oil flows through an annular flow passage 156 and makes two complete passes around the interior of motor housing section 16 before being directed to the bearing surfaces of the compressor. This arrangement allows for the prolonged exposure of the oil to the suction gas flowing through the motor housing section and thus for enhanced suction gas cooling of the oil. As with the preferred embodiment of FIGS. 1 through 3, the heat exchanger portion of the motor housing in the embodiment of FIGS. 4 and 5 is an integral heat exchanger formed by the attachment of end cap 20 to main motor housing 58.

FIG. 5 additionally illustrates the existence of a debris collecting pocket 158 in communication with flow passage 156. Pocket 158 is formed cooperatively by end cap 20 and main motor housing 58 and is at the radially outward portion of passage 156 in the lower portion of the passage. Sediment carried in the oil flowing through passage 156 will tend to be found in the radially outward portion of the passage, due to its annular nature and the centrifugal force which acts on sediment being carried through the passage. Therefore, such sediment will tend to enter and be trapped in pocket 158. Such debris is therefore prevented from being carried to the bearing surfaces in the compressor by the lubricating oil. Pocket 158 is formed such that it has little or no affect on the flow of oil through passage 156.

Figure 6:
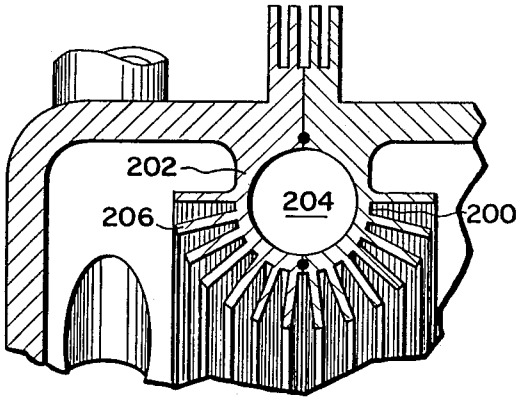
FIG. 6 is a cross-sectional view of an alternative embodiment of the integral heat exchanger of the present invention having an enhanced heat exchange surface.

Referring to FIG. 6, a third embodiment of the present invention is illustrated. In this embodiment, the ability of the exterior surface 200 of integral heat exchanger 202 to transfer heat from the oil in passage 204 to suction gas is enhanced by the addition of fins 206 to the heat exchange surface exposed to suction gas. The double passage feature of the embodiment of FIGS. 4 and 5 can, of course, be combined with the enhanced heat exchange surface feature of the embodiment of FIG. 6. Iikewise, the enhanced heat exchanger surface of FIG. 6 is applicable to the embodiment of FIGS. 1 through 3.

While a preferred and two alternative embodiments of the present invention have been described above, it will be understood by those skilled in the art that various changes in form and detail may be made to them without departing from the spirit and scope of the invention.

What is claimed is:

1. A lubrication system for a compressor assembly through which a lubricant circulates and in which the pressure of a gas is increased from alower to a higher pressure when the assembly is in operation, the assembly having locations that are at a pressure less than the higher pressure and which require lubrication when the assembly is operating, comprising:

a compressor defining a working chamber in which a pair of screw rotors are meshingly disposed to compress gas;

means for separating entrained lubricant from gas compressed in said working chamber, said separating means having a sump connected by a lubricant passage to said locations in said assembly requiring lubrication, the interior of said separating means, including said sump, being at said higher pressure when said compressor assembly is operating, the difference in pressure between said sump and said locations requiring lubrication causing lubricant to be continuously driven from said sump, through said passage and to said locations requiring lubrication when said compressor assembly is operating;

means for driving said compressor, said driving means being cooled by gas at said lower pressure; and means for enclosing said driving means, the interior of said enclosing means both directing the flow of gas at said lower pressure into a heat exchange relationship with said driving means and defining a path for the flow of said lower pressure gas to said compressor, said enclosing means having an integral internal heat exchange structure which defines a portion of said lubricant passage, said structure being exposed to the flow of said lower pressure gas through said enclosing means so that lubricant flowing through said passage is cooled by said lower pressure gas subsequent to being driven from said sump and prior to reacing said locations requiring lubrication.

2. The compressor assembly according to claim 1 wherein said means for enclosing comprises a housing and wherein said integral internal heat exchange structure extends inwardly of said housing into the path of the lower pressure gas flowing through said housing.

3. The compressor assembly according to claim 2 wherein said housing is generally cylindrical and wherein said integral internal heat exchange structure is annular in nature.

4. The compressor assembly according to claim 3 wherein said housing is a two-part housing, each part of said two-part housing cooperating with the other to define said integral internal heat exchange structure.

5. The compressor assembly according to claim 4 wherein said housing further comprises an external integral heat exchange structure, said external integral heat exchange structure being proximate said portion of said oil passage defined by said internal integral heat exchange structure so that oil flowing through said portion of said passage is brought additionally into heat exchange contact with the ambient exterior of said housing.

6. The compressor assembly according to claim 4 wherein said internal integral heat exchange structure includes a finned surface exposed to suction gas.

7. The compressor assembly according to claim 4 wherein the portion of said oil passage defined by said internal integral heat exchange structure makes more than one pass around the interior of said housing so that the exposure of oil flowing through said portion of said passage to suction gas flowing through said housing is prolonged.

8. The compressor assembly according to claim 4 further comprising means, disposed in said portion of said passage interior of said internal integral heat exchange structure, for filtering debris from oil flowing therethrough.

9. The compressor assembly according to claim 4 further comprising means for controllably restricting the flow of oil from said sump to the portion of said oil passage defined by said internal integral heat exchange structure.

10. A screw compressor assembly through which a lubricant circulates in operation, comprising:

a compressor section defining a working chamber in which a pair of screw rotors are mounted for rotation so as to compress a gas from asunction to a discharge pressure, said compressor section having surfaces that are exposed to a pressure less than discharge pressure and which require lubrication when said assembly is in operation;

means for separating lubricant from the mixture of lubricant and gas discharged from said compressor section when said compressor section is in operation, the interior of said separating means defining a sump which is at discharge pressure and the difference in pressure between said sump and said surfaces which require lubrication causing lubricant to continuously circulate from said sump to said surfaces requiring lubrication when said compressor is in operation;

a motor for driving said rotors, said motor being cooled by suction gas; and a motor housing section attached to said compressor section for at least semi-hermetically enclosing said motor, said motor housing defining a path for the flow of suction gas into said compressor section and around and through said motor for heading exchange therewith, said motor housing further defining an internal integral heat exchange structure which defines a passage in flow communication with said sump and with said surfaces requiring lubrication, said internal integral heat exchange structure having a surface in heat exchange contact with suction gas passing through said motor housing so that lubricant circulating through said passage is cooled by suction gas prior to its delivery from said sump to said surfaces requiring lubrication.

11. The compressor assembly according to claim 10 wherein said motor housing section is a generally cylindrical two-part housing section and wherein said integral internal heat exchange structure is annular in nature and extends inwardly of said housing section at a location downstream of the location where suction gas enters said housing, the parts of said two-part housing section cooperating to define said integral internal heat exchange structure.

12. The compressor assembly according to claim 11 wherein said surface of said internal integral heat exchange structure is a finned surface.

13. The compressor assembly according to claim 11 wherein said two-part housing section further comprises an external integral heat exchange structure, said external structure being cooperatively defined by said two-part housing section and being proximate said oil flow passage defined by said internal integral heat exchange structure so that oil flowing through said internal heat exchange structure is brought additionally into heat exchange contact with the ambient exterior of said two-part housing section.

14. The compressor assembly according to claim 11 further comprising means for collecting debris carried in oil flowing through said internal heat exchange structure.

15. The compressor assembly according to claim 14 further comprising means for controllably restricting the flow of oil from said sump into said internal integral heat exchange structure.

16. The compressor assembly according to claim 15 wherein said surface of said internal heat exchange structure exposed to suction gas is a finned surface and wherein said housing further comprises an integral external heat exchange structure proximate said oil flow passage defined by said internal heat exchange structure.

17. A compressor drive motor assembly, for a screw compressor assembly through which a lubricant circulates, the compressor assembly having both a lubricant sump which is at discharge pressure in operation and a compressor having locations which require lubrication, comprising:

means for delivering compressor suction gas into the interior of said drive motor assembly;

a motor drivingly connected to said compressor and disposed in said drive motor assembly so that said suction gas directed into the interior of said assembly is brought into heat exchange contact with said motor;

a main motor housing disposed around said drive motor and attached to said compressor, said main motor housing defining a heat exchange portion connected for flow to both said lubricant sump and to said locations in said compressor which require lubrication; and an end cap attached to said main motor housing to semi-hermetically close said drive motor assembly around said drive motor, said end cap including an internal heat exchange portion which cooperates with said main motor housing heat exchange portion to define both a passage for the flow of lubricant passing from said sump to said locatiosn requiring lubrication and an integral heat exchange structure exposed to suction gas flow through said drive motor assembly so that suction gas flowing through said assembly is brought into heat exchange contact with lubricant flowing through said cooperatively defined flow passage when said compressor assembly is in operation.

18. The compressor drive motor assembly according to claim 17 wherein said integral heat exchange structure extends inwardly of said drive motor assembly and is generally annular in nature.

19. The compressor drive motor assembly according to claim 18 wherein said main motor housing and end cap cooperate to define a debris collecting pocket in flow communication with said cooperatively defined oil flow passage.

20. The compressor drive motor assembly according to claim 19 further comprising means for controllably restricting the flow of oil from said sump to the oil passage internal of said integral heat exchange structure.

* * * * *

UNITED STATES PATENT AND TRADEMARK OFFICE

CERTIFICATE OF CORRECTION

PATENT NO. : 4,780,061

DATED : October 25, 1988

INVENTOR(S) :

It is certified that error appears in the above-identified patent and that said Letters Patent is hereby corrected as shown below:

In The Specification:

Column 2, line 11, "f" should be --of--.

Column 5, line 44, "t" should be --at--.

In The Claims:

Claim 1, Column 6, line 66, "alower" should be --a lower--.

Claim 1, Column 7, line 33, "reacing" should be --reaching--.

Claim 10, Column 8, line 13, "asunction" should be --a suction--.

Claim 10, Column 8, line 34, "heading" should be --heat--.

Claim 17, Column 10, line 9, "locatiosn" should be --locations--.

Signed and Sealed this

Twenty-eighth Day of February, 1989

*Attest:*

DONALD J. QUIGG

*Attesting Officer*

*Commissioner of Patents and Trademarks*